US005453811A

United States Patent [19]

Yamamoto

[11] Patent Number: 5,453,811

[45] Date of Patent: Sep. 26, 1995

[54] CARRIER GUIDE FOR USE IN PHOTOPROCESSING APPARATUS

[75] Inventor: Yuji Yamamoto, Wakayama, Japan

[73] Assignee: Noritsu Koki Co., Ltd., Wakayama, Japan

[21] Appl. No.: 206,622

[22] Filed: Mar. 7, 1994

[30] Foreign Application Priority Data

Mar. 8, 1993 [JP] Japan ..... 5-075401

[51] Int. Cl.[6] ..... G03D 13/08

[52] U.S. Cl. ..... 354/339

[58] Field of Search ..... 354/319–325, 354/331, 33 L, 338, 339, 308, 310, 313, 328, 317, 318, 337, 340; 134/108; 355/271, 100, 53

[56] References Cited

U.S. PATENT DOCUMENTS 3,767,302 10/1973 Roberts et al. ..... 355/53
4,053,225 10/1977 Morohashi ..... 355/100
4,072,412 2/1978 Suda et al. ..... 355/274
4,943,823 7/1990 Uchiyama et al. ..... 354/322
5,004,000 4/1991 Berruex ..... 134/108
5,043,756 8/1991 Takabayashi et al. ..... 354/331 X
5,063,401 11/1991 Oberkersch et al. ..... 354/338 X

*Primary Examiner*—D. Rutledge
*Attorney, Agent, or Firm*—Wenderoth, Lind & Ponack

[57] ABSTRACT

A carrier guide can prevent treating solutions from crystallizing thereon and thus can prevent photosensitive materials from clogging and getting damaged and does not require frequent cleaning. The guide surface of the guide provided over the treating tanks is constituted by a water-repellent or ultra-water-repellent layer so that it will repel any treating solution.

3 Claims, 2 Drawing Sheets

CARRIER GUIDE FOR USE IN PHOTOPROCESSING APPARATUS

BACKGROUND OF THE INVENTION

This invention relates to a carrier guide for use in a photoprocessing apparatus for automatically developing and processing photosensitive materials such as films and photographic paper.

A conventional photosensitive material carrier guide for use in an automatic photoprocessing apparatus is made of synthetic resin or metal. When fed out of the treating solution in each treating tank, photosensitive materials are brought into contact with, and guided by, carrier guides which are not immersed in the treating solution. Thus, part of the treating solution on the photosensitive material comes into contact with or splashed onto the carrier guide surfaces. When the solution adhering to the guide surfaces dries, metallic solvent which is dissolved in the treating solution will crystallize and adhere to the guide surfaces.

Such crystallized metallic solvent may damage the surface of the photosensitive material in the subsequent developing cycles. This will not only lower the quality of the developed materials but will hamper a smooth feeding of photosensitive materials.

SUMMARY OF THE INVENTION

An object of this invention is to provide a carrier guide which eliminates the necessity of day-to-day troublesome maintenance of the apparatus, i.e. which makes it unnecessary to disassemble and clean the carrier guides one by one after every day's work and which can save much labor and improve processing efficiency.

In order to attain this object, according to this invention, there is provided a carrier guide for use in a photoprocessing apparatus for automatically developing photosensitive materials such as photographic paper and films by feeding them through treating solutions in tanks, the carrier guide having a portion not immersed in the treating solutions, at least this portion being provided with a water-repellent or ultra-water-repellent layer. Due to the provision of the water-repellent layer, any developing solution that may contact or splash onto the guide surface will separate quickly therefrom and drop into the tanks. Thus, no treating solution will crystallize on the guide surface, so that photosensitive materials are less likely to sustain damage and can be fed smoothly.

When lifted out of the treating solution in each tank, the photosensitive material makes a U-turn guided by the carrier guides with the water-repellent or ultra-water-repellent layer on the guide surface which is located above the surface of the treating solutions. Thus, any treating solution on the photosensitive material can be wiped off by the arcuate water-repellent surfaces of the guides. Also, any solution moved or splashed onto the guide surfaces will separate quickly therefrom and drop into the tanks before it dries up, so that the metallic solvents contained in the solutions will never crystallize and adhere to the guide surfaces.

This eliminates the necessity of day-to-day troublesome maintenance of the apparatus. More specifically, it is not necessary to disassemble and clean the carrier guides one by one after every day's work.

Since the guide surfaces are always kept smooth, photosensitive materials will never be damaged by the guide surfaces. Thus, it is possible to improve the quality of the developed and printed materials. Also, it is possible to feed photosensitive materials smoothly without the possibility of clogging.

BRIEF DESCRIPTION OF THE DRAWINGS

Other features and objects of the present invention will become apparent from the following description made with reference to the accompanying drawings, in which.

Figure 1:
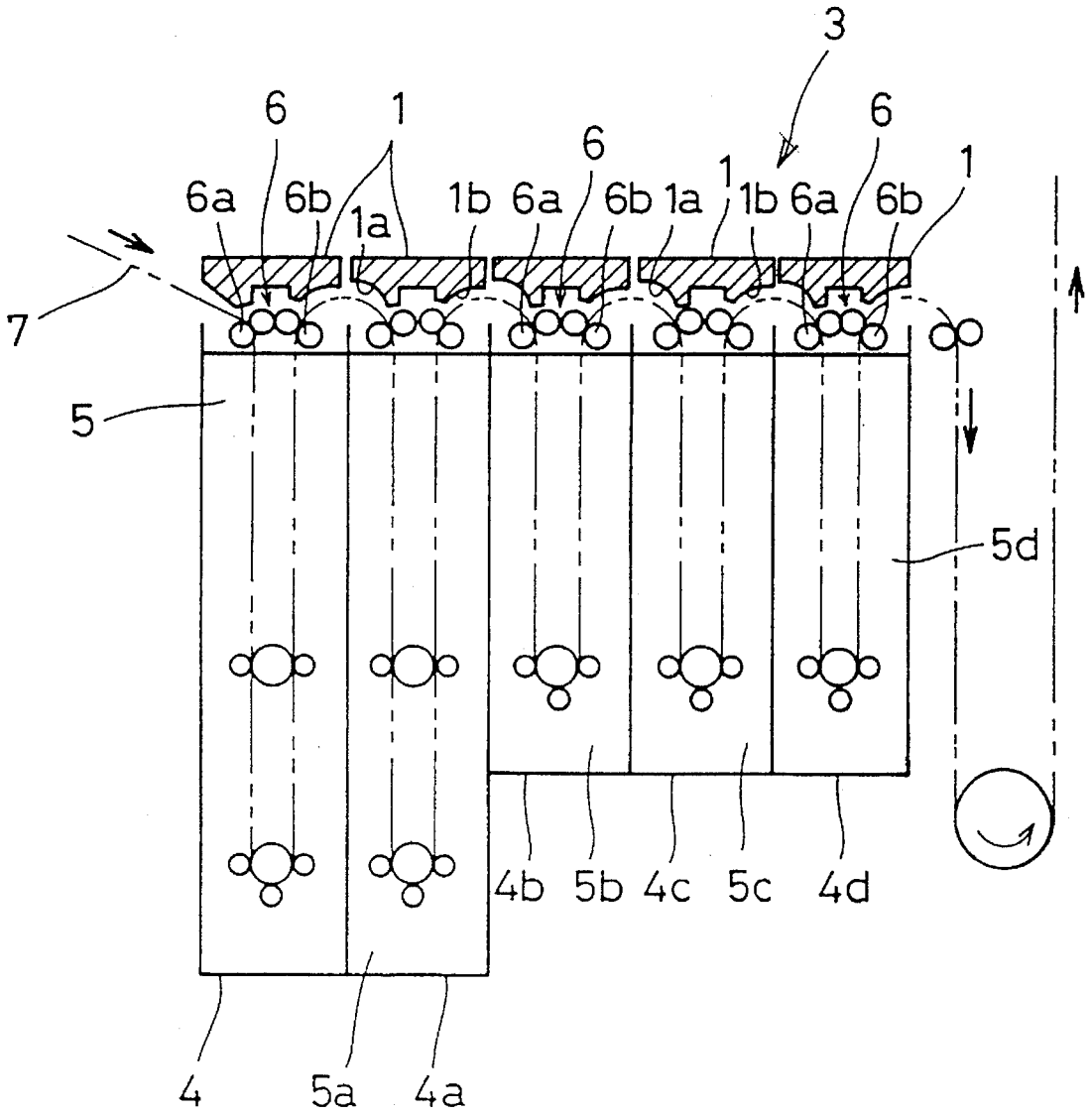
FIG. 1 is a vertical sectional view of a developing unit in an automatic photoprocessing apparatus.

Now referring to the drawings, an embodiment of the photosensitive material carrier guide according to this invention will be described below.

DETAILED DESCRIPTION OF THE PREFERRED EMBODIMENT

Figure 2:
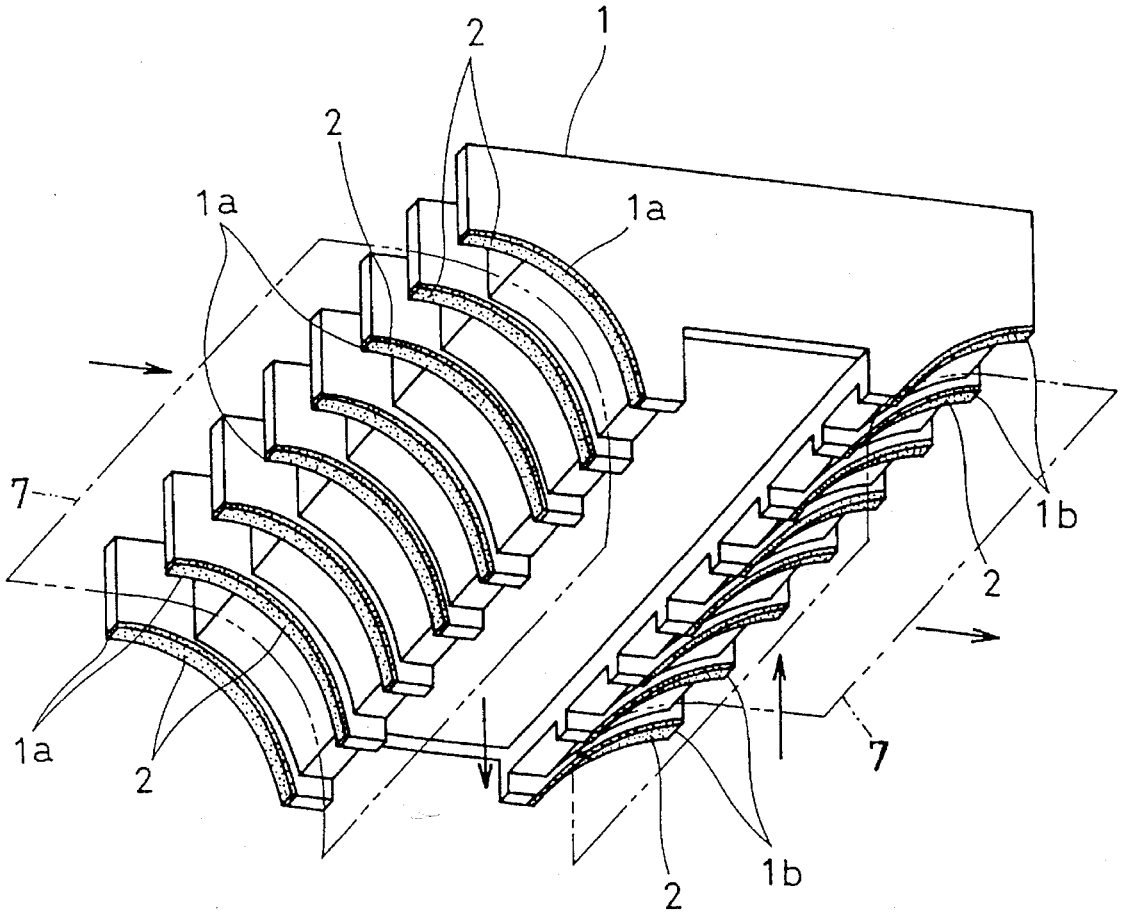
FIG. 2 is a perspective view of the upper turn guide in the developing unit.

FIG. 1 shows the photosensitive material carrier for use in an automatic photoprocessing apparatus embodying this invention. In FIGS. 1 and 2, numerals 1 designate upper turn guides of the carrier which are provided at the top of a developing unit 3.

The upper turn guides 1 are provided over respective carrier units 6 which comprise rollers and guides arranged in series in the form of a rack and immersed in developing, bleaching, fixing, stabilizing and rinsing solutions 5, 5*a*, 5*b*, 5*c* and 5*d* in tanks 4, 4*a*, 4*b*, 4*c* and 4*d*. Each turn guide has an infeed guide surface 1*a* and a delivery guide surface 1*b* which are arranged opposite to each other and are convex in a direction away from the treating solutions 5, 5*a*, 5*b*, 5*c*, and 5*d* so as to correspond to the infeed and delivery rollers 6*a*, 6*b* provided over the surface of the treating solutions 5, 5*a*, 5*b*, 5*c* and 5*d* in the tanks 4, 4*a*, 4*b*, 4*c* and 4*d*. The guide surfaces 1*a*, 1*b* are subjected to water-repellent or ultra-water-repellent treatment to provide water-repellent layers 2 thereon.

Such water-repellent or ultra-water-repellent layers 2 may be formed in any desired way, e.g. by applying, spraying, baking or dispersion-plating a water repellent or ultra-water repellent onto the guide surfaces 1*a*, 1*b* of the upper turn guides 1.

Applicable water repellents include rubbers, silicones and fluororesins. Among fluororesins, Teflon is most often used. Graphite fluoride is one of the best known ultra-water repellents.

The treating steps carried out in the developing unit 3 will be described. A web of photosensitive material 7 such as film or photographic paper is fed along a feed path through the developing unit 3 by the carrier unit 6 so as to be immersed in the treating solutions 5, 5*a*, 5*b*, 5*c* and 5*d* in the tanks 4, 4*a*, 4*b*, 4*c* and 4*d* one after another. Between the tanks 4 and 4*a*, a photosensitive material 7 is lifted out of the treating solution 5 by the delivery roller 6*b* and is exposed to the air. It then makes a U-turn guided by upper turn guides 1 and is immersed in the treating solution 5*a* by the infeed roller 6*a*. In the same manner the photosensitive material 7 is immersed in the treating solutions 5*b*, 5*c* and 5*d* in the tanks 4*b*, 4*c* and 4*d* one after another and discharged from the developing unit 3.

In the embodiment, water-repellent or ultra-water-repellent layers 2 are formed only on the guide surfaces 1*a* and 1*b* of the upper turn guides. But such layers may be formed on the entire surface of the upper turn guides 1.

What is claimed is;

1. In a photoprocessing apparatus having treating tanks containing liquid treating solutions for use in developing photosensitive materials, a photosensitive material carrier comprising: a carrier guide disposed over the treating solution in one of the tanks, said carrier guide having a stationary guide surface located in a feed path along which photosensitive material is fed in the apparatus through the treating solutions, said guide surface being a layer of one of a water-repellant and an ultra-water-repellant material such that said guide surface guides the photosensitive material along said feed path and treating solution is prevented from adhering to the guide surface.

2. A photosensitive material in a photoprocessing apparatus as claimed in claim 1, wherein said carrier guide is an upper turn guide, the guide surface of which is convex in a direction away from the treating solution in said one of the tanks and is disposed in a portion of the feed path along which photosensitive material passes from one of the tanks to another of the tanks.

3. In a photoprocessing apparatus having treating tanks containing liquid treating solutions for use in developing photosensitive materials, a photosensitive material carrier comprising: a plurality of upper turn guides disposed over the treating solutions in the tanks, respectively, the upper turn guides having stationary guide surfaces located in a feed path along which photosensitive material is fed in the apparatus through the treating solutions, the guide surfaces forming inverted U-shaped portions of the feed path confronting upper surfaces of the treating solutions so as to guide the photosensitive material from and into the tanks, and said guide surfaces being layers, respectively, of one of a water-repellant and an ultra-water-repellant material such that the treating solutions are prevented from adhering to the guide surfaces.

* * * * *